US011439179B2

(12) United States Patent
Slama

(10) Patent No.: US 11,439,179 B2
(45) Date of Patent: Sep. 13, 2022

(54) PORTABLE EXTINGUISHER FOR AEROSOL GENERATING ARTICLE

(71) Applicant: PHILIP MORRIS PRODUCTS S.A., Neuchâtel (CH)

(72) Inventor: Philippe Slama, Pully (CH)

(73) Assignee: Philip Morris Products S.A., Neuchâtel (CH)

( * ) Notice: Subject to any disclaimer, the term of this patent is extended or adjusted under 35 U.S.C. 154(b) by 329 days.

(21) Appl. No.: 16/337,519

(22) PCT Filed: Sep. 13, 2017

(86) PCT No.: PCT/IB2017/055530

§ 371 (c)(1),
(2) Date: Mar. 28, 2019

(87) PCT Pub. No.: WO2018/060801

PCT Pub. Date: Apr. 5, 2018

(65) Prior Publication Data

US 2019/0223495 A1 Jul. 25, 2019

(30) Foreign Application Priority Data

Sep. 28, 2016 (EP) ..... 16191137

(51) Int. Cl.
*A24F 13/20* (2006.01)
*A24F 13/18* (2006.01)

(52) U.S. Cl.
CPC ..... *A24F 13/20* (2013.01); *A24F 13/18* (2013.01)

(58) Field of Classification Search
CPC ..... A24F 13/18; A24F 13/20
(Continued)

(56) References Cited

U.S. PATENT DOCUMENTS 450,312 A * 4/1891 Hieatzman ..... A24F 13/18 131/256
1,342,512 A * 6/1920 Skinderviken ..... A24F 13/18 206/270

(Continued)

FOREIGN PATENT DOCUMENTS

CN 2185508 Y 12/1994
DE 102004007502 A2 9/2005

(Continued)

OTHER PUBLICATIONS

Machine Translation of WO 01/39618 (Year: 2001).*

(Continued)

*Primary Examiner* — Kelly M Gambetta
*Assistant Examiner* — Russell E Sparks
(74) *Attorney, Agent, or Firm* — Mueting Raasch Group

(57) ABSTRACT

A portable extinguisher for an aerosol generating article having a solid heat source is described. The extinguisher includes an inner element extending between a first portion and an opposing second portion and having a longitudinal axis. An outer shell completely surrounds at least a portion of the inner element. The outer shell is slidable along the longitudinal axis of the inner element between an open position and a covered position. The first portion includes a cavity sized to receive a solid heat source of an aerosol generating article. The cavity is accessible in the open position and surrounded by the outer shell in the covered position.

20 Claims, 3 Drawing Sheets

(58) Field of Classification Search
USPC ..... 131/256
See application file for complete search history.

(56) References Cited

U.S. PATENT DOCUMENTS

| | | | | | |
|---|---|---|---|---|---|
| 2,768,631 | A * | 10/1956 | Russell | A24F 19/14 131/235.1 |
| 4,066,088 | A * | 1/1978 | Ensor | A24F 13/00 131/185 |
| 8,706,021 | B2 | 4/2014 | An et al. | |
| 9,339,061 | B2 * | 5/2016 | Meyer | A24F 13/00 |
| 2008/0251089 | A1 | 10/2008 | Granda et al. | |
| 2015/0300641 | A1 | 10/2015 | Nymeyer et al. | |

FOREIGN PATENT DOCUMENTS

| | | | | | |
|---|---|---|---|---|---|
| EP | 2953489 | B1 | | 10/2017 | |
| FR | 2695009 | | | 3/1994 | |
| GB | 219216 | A | * | 7/1924 | A24F 13/18 |
| GB | 294823 | A | * | 8/1928 | A24F 13/18 |
| JP | S61-242571 | A | | 10/1986 | |
| JP | H02-79964 | A | | 3/1990 | |
| JP | 3030258 | U | | 10/1996 | |
| JP | H09224634 | A | | 9/1997 | |
| JP | H09308478 | | | 12/1997 | |
| JP | 3048989 | U | | 5/1998 | |
| JP | 200732852 | A | | 2/2007 | |
| KR | 20120011708 | A | | 2/2012 | |
| RU | H1033156 | A | | 2/1998 | |
| RU | 28588 | U1 | | 4/2003 | |
| RU | 2519902 | C2 | | 6/2014 | |
| WO | WO-0139618 | A1 | * | 6/2001 | A24F 13/18 |
| WO | WO 2004/019710 | A1 | | 3/2004 | |
| WO | WO 2009/022232 | A2 | | 2/2009 | |
| WO | WO 2012/110948 | A1 | | 8/2012 | |
| WO | WO 2012/164077 | A1 | | 12/2012 | |
| WO | WO 2014/122200 | A1 | | 8/2014 | |
| WO | WO-2014122200 | A1 | * | 8/2014 | A24F 13/18 |
| WO | WO 2015/189416 | A2 | | 12/2015 | |

OTHER PUBLICATIONS

The Use of Sodium Chloride & Aluminum as Phase Change Materials for High Temperature Thermal Energy Storage Characterized by Calorimetry, Solomon, L., Lehigh University, https://ui.adsabs.harvard.edu/abs/2013PhDT.....2S/abstract (Year: 2013).*

Merriam Webster Dictionary, Definition of Length, https://www.merriam-webster.com/dictionary/length (Year: 2021).*

Machine Translation of FR 2695009 (Year: 1994).*

Machine Translation DE 102004007502 (Year: 2005).*

European Search Report for EP 16191137.5, issued by the European Patent Office dated Feb. 24, 2017; 6 pgs.

International Search Report and Written Opinion for PCT/IB2017/055530, issued by the European Patent office dated Nov. 30, 2017; 13 pgs.

Russian Decision to Grant and Search Report issued for RU Application No. 2019108805, by the Patent Office of the Russian Federation, dated Nov. 25, 2020; 16 pgs. including English Translation.

International Preliminary Report on Patentability for PCT/IB2017/055530, issued by the International Bureau of WIPO dated Apr. 11, 2019; 7 pgs.

Chinese Office Action for CN 201780054857.3 issued by the Chinese National Intellectual Property Administration, dated May 27, 2021; 20 pgs. including English translation.

Japanese Office Action for JP 2019-537901, issued by the Japanese Patent Office dated Sep. 1, 2021; 13 pgs. Including English translation.

* cited by examiner

PORTABLE EXTINGUISHER FOR AEROSOL GENERATING ARTICLE

This application is the § 371 U.S. National Stage of International Application No. PCT/IB2017/055530, filed 13 Sep. 2017, which claims the benefit of European Application No. 16191137.5, filed 28 Sep. 2016.

This disclosure relates to a portable extinguisher for an aerosol generating article having a heat source for heating an aerosol-forming substrate.

A number of smoking articles in which tobacco is heated rather than combusted have been proposed in the art. In one known type of heated smoking article, an aerosol is generated by the transfer of heat from a combustible heat source to a physically separate aerosol-forming substrate, for example containing tobacco. The aerosol-forming substrate may be located within, around or downstream of the combustible heat source. For example, WO-A2-2009/022232 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate. During use, volatile compounds are released from the aerosol-forming substrate by heat transfer from the combustible heat source and entrained in air drawn through the smoking article. As the released compounds cool, they condense to form an aerosol that is inhaled by the user.

Aerosol generating articles which include a combustible fuel element or heat source may have a combustion zone or zone of heating that is larger, more dense, and not as readily extinguished by crushing or "stubbing out" the heat source, as compared to, for example a conventional cigarette, in which tobacco is burnt or combusted to heat and release volatile compounds from the tobacco. Such aerosol generating articles may have a solid heat source that contains significantly more energy in the form of heat than found in the combustion zone of a conventional cigarette. Consequently, such aerosol generating articles may require more effort to extinguish or to remove heat to facilitate disposal.

It would be desirable to provide a portable extinguisher for an aerosol generating article that may conveniently extinguish a combusting solid heat source of the aerosol generating article on demand. In particular, it would be desirable to provide a portable extinguisher that may be operated with a single hand, and is simple to use. It may be desirable to provide a portable extinguisher with a lighting element to ignite a solid heat source.

According to an aspect of the invention, a portable extinguisher for an aerosol generating article having a solid heat source is described. The portable extinguisher includes an inner element extending between a first portion and an opposing second portion and having a longitudinal axis. The first portion comprises a cavity sized to receive a solid heat source of an aerosol generating article. An outer shell completely surrounds at least a portion of the inner element. The outer shell is slidable along the longitudinal axis of the inner element between an open position and a covered position. The cavity is accessible in the open position and surrounded by the outer shell in the covered position.

The portable extinguisher may include a driving element fixed to the inner element that is movable along a guide element of the outer shell to move the inner element between an open position and a covered position. The cavity may be configured to separate the combusting solid heat source from the consumed aerosol generating article. The inner element may include two or more cavities. The cavity or outer shell may be insulated to contain or dissipate the heat remaining in the received solid heat source.

Advantageously, the portable extinguisher may extinguish a solid heat source received in the cavity and dissipate or retain heat generated from the received heat source. The portable extinguisher may be held and operated with a single hand. Two or more solid heat sources may be extinguished at the same time. The outer shell may maintain an outer surface temperature of less than 50 degrees Celsius when extinguishing a combusting heat source.

According to another aspect of the invention, the portable extinguisher may include a heating element on the second portion of the inner element. The outer shell may be configured to be co-extensive with the inner element in the covered position. The outer shell may be slidable along the longitudinal axis of the inner element to expose the heating element. The consumer may activate the heating element to ignite a solid heat source of an aerosol generating article.

Advantageously, the portable extinguisher may include a heating element that is configured to ignite a solid heat source of an unused aerosol generating article. Thus the portable extinguisher may be a dual purpose device that may both ignite and extinguish these heat sources.

According to an aspect of the invention, the portable extinguisher may define an elongated obround body. Advantageously, this may allow the user to easily utilize the portable extinguisher with a single hand.

The term "aerosol-forming substrate" refers to a substrate capable of releasing, upon heating, volatile compounds, which may form an aerosol. The aerosols generated from aerosol-forming substrates of articles according to the invention may be visible or invisible and may include vapours (for example, fine particles of substances, which are in a gaseous state, that are ordinarily liquid or solid at room temperature) as well as gases and liquid droplets of condensed vapours. Preferably, the aerosol-forming substrate includes nicotine or a nicotine source. Preferably, the nicotine comes from tobacco material. The aerosol-forming material is preferably solid and made from tobacco leaf material.

The term "carbonaceous" refers to a material that comprises carbon, such as carbon powder, for example.

This disclosure relates to a portable extinguisher for a solid heat source of an aerosol generating article. The portable extinguisher includes an inner member extending between a first portion and an opposing second portion and having an elongated longitudinal axis. The first portion includes a cavity sized to receive and contain a combusting solid heat source. An outer shell or sleeve is disposed about the inner member and is movable or slidable along the longitudinal axis. The cavity may have a length extending along a direction that is orthogonal to the inner member longitudinal axis. The combusting heat source may be inserted into the cavity and snapped off or cut from the aerosol generating article. The received combusting solid heat source may then be enclosed within the cavity and extinguished. The outer shell or sleeve may move along the longitudinal axis to close or seal the open end of the cavity. The covered, closed or sealed cavity may extinguish the combusting heat source. The cavity or the outer shell or sleeve may be heat insulating to retain the remaining heat emitted from the contained heat source. The extinguisher may dissipate the heat emitted from the combusting solid heat source (act or function as a heat sink). For example, the inner member forms a heat sink that contains and dissipates heat within the inner member body. The covered, closed or sealed cavity may restrict or prevent air or oxygen transport into the cavity and the combusting solid heat source and facilitate extinguishment of the heat source. The portable extinguisher may include a driving member fixed to the inner member that allows a user to move the outer sleeve into the covered position without the user contacting a heated surface. The driving member may be operated by the thumb, for example, of the user and may be operated by a single hand of the user. The portable extinguisher may include a heating element on the opposing second portion of the inner member. This heating element may retract into the outer sleeve. The outer sleeve may be coextensive with the inner element in at least one closed position.

Heat insulating material acts as a thermal barrier and has a reduced thermal conductivity value. Heat conducting (heat sink) material has an increased thermal conductivity value and dissipates heat by thermal conduction. Heat conducting materials may include metal, such as stainless steel or aluminum, and the like. Heat insulating materials include polymer, glass, clay, silicones, ceramic, aerogels, and the like. The material forming portions of the extinguisher may be formed any material that may withstand temperatures of at least about 350 degrees Celsius or least about 500 degrees Celsius or least about 600 degrees Celsius.

The extinguisher includes an inner member extending between a first portion and an opposing second portion. The inner member defines an elongated body having a longitudinal axis. The inner member may define any elongated shape. The inner member may define an elongated circular shape or an elongated non-round shape. The inner member may define an elongated obround shape. The inner member may define an elongated polygonal shape. Exemplary polygonal shapes include trigonal shape, octagonal shape, rhomboidal shape, trapezoidal shape, and the like, in cross-section. Preferably, the inner member defines an elongated obround shape.

The inner member may have a length (along the longitudinal axis) of less than about 120 mm, or less than about 100 mm or less than about 80 mm. The inner member may have a length in a range from about 40 mm to about 120 mm, or from about 50 mm to about 100 mm, or from about 50 mm to about 80 mm, or from about 50 mm to about 70 mm.

A cavity is defined in the first portion of the inner member. The cavity has a closed end within the inner member and an open end for receiving a heat source. Two or more cavities may be defined in the first portion of the inner member. The cavity or cavities may be sized to receive and contain a heat source for an aerosol generating article. The cavity or cavities may be cylindrical extending from the closed end to the open end. Preferably, the cavity or cavities extend along a direction orthogonal or perpendicular to the longitudinal axis of the inner member. Thus, the heat source may be inserted into the inner member along a direction orthogonal or perpendicular to the longitudinal axis of the inner member.

The cavity may have a diameter sufficient to enclose a combusting solid heat source of the aerosol generating article. The cavity may have a length sufficient to enclose a combusting solid heat source of the aerosol generating article. The cavity may have a length sufficient to enclose only a combusting solid heat source of the aerosol generating article. The cavity may have a length that is less than about 40% of the length of the aerosol generating article, or less than about 30% of the length of the aerosol generating article, or less than about 20% of the length of the aerosol generating article, or less than about 10% of the length of the aerosol generating article.

The cavity or cavities may have a diameter in a range from about 5 mm to about 12 mm, or from about 6 mm to about 10 mm or from about 7 mm to about 9 mm. The cavity or cavities may have a length (or depth) in a range from about 10 mm to about 30 mm, or from about 14 mm to about 25 mm or from about 16 mm to about 20 mm.

The cavity may be defined of a material that may withstand a temperature of at least 700 degrees Celsius for at least 10 seconds. The cavity may be defined by a heat conducting material. The cavity may be defined by a heat insulating material. The cavity may be defined by a metal. The cavity may be defined by a ceramic. The cavity may be defined by a polymer. The cavity may be defined by an aerogel. At least a portion of the cavity surface may be a heat conducting material to direct heat out of the cavity. A heat sink may be in thermal contact with the heat conducting material. The heat sink may include a mass of heat conducting material such as metal, for example, or heat radiating elements, such as fins, or a phase change material. A phase change material absorbs heat due to the phase change of the material. The heat sink may be contained within the inner member. As used throughout this specification, the term "phase change material" preferably refers to a material having a high latent heat of transition, for example at least about 90 kJ/kg and preferably at least about 140 kJ/kg.

Phase change material may be contained in a reservoir and disposed within the inner member. The phase change material may be in thermal contact with the cavity and be configured to remove heat from the cavity and extinguish the heat source contained within the cavity. The phase change material may absorb heat at least in part due to a solid-to-liquid phase change. Preferably the phase change material absorbs heat at least in part due to a liquid-to-gas phase change. In one embodiment, the reservoir contains a phase change solid. However, any suitable fluid, phase change solid, or combination of fluids, combination of phase change solids, or combination of fluids and phase change solids may be used. In use, the phase change material does not come into direct physical contact with the heat source, but rather, through indirect thermal contact, draws heat away from the cavity that is in direct thermal contact with the heat source contained (completely) within the cavity.

The phase change material may have a transition temperature of from about 40 degrees Celsius to about 600 degrees Celsius, or from about from about 50 degrees Celsius to about 300 degrees Celsius, preferably from about 100 degrees Celsius to about 200 degrees Celsius. The phase change material may be water, for example. Alternatively, or in addition, the phase change material may be a volatile liquid with a low boiling point. Suitable volatile liquids include, but are not limited to, ammonia, alcohol (such as methanol or ethanol), water, propane and butane, or combinations thereof. As used herein, "volatile" refers to a liquid having a vapour pressure of at least about 20 Pa. Unless otherwise stated, all vapour pressures referred to herein are vapour pressures at 25° C. measured in accordance with ASTM E1194-07.

The cavity or cavities may be configured to break off the combusting solid heat source from the aerosol generating article. The cavity may have a blunt outer edge that may shear off the combusting solid heat source by bending the aerosol generating article once the combusting solid heat source is received in the cavity. The blunt edge may facilitate separation of the solid heat source from the aerosol generating article. The cavity may have a rounded or curved outer edge that may shear off the combusting solid heat source by bending the aerosol generating article once the combusting solid heat source is received in the cavity.

The cavity or cavities may be configured to cut off the combusting solid heat source from the aerosol generating article. The cavity may include a sharp edge or cutting element along the outer edge that may cut off the combusting solid heat source by bending the aerosol generating article once the combusting solid heat source is received in the cavity. The cutting element may facilitate separation of the solid heat source from the aerosol generating article. The cutting element may be a thin cutting edge, such as a razor blade edge, for example. The cutting element may be fixed to the inner member and extend parallel with the longitudinal axis of the inner member.

A heating element may be disposed on the second portion of the inner member. The heating element may be configured to ignite a heat source for an aerosol generating article. The heating element may be a flame lighter. The heating element may be an electric heating element. A battery or rechargeable power supply may be electrically connected to the electric heating element. The battery or rechargeable power supply may be contained within the inner member. A USB element may be electrically connected to the battery or rechargeable power supply to provide recharging power or voltage to the battery or rechargeable power supply. The USB element may be disposed on or within the inner member. Preferably the USB element is a micro-USB device.

An outer shell is disposed about the inner member. The outer shell may completely surround at least a portion of the inner member. The outer shell may be movable or slidable (relative to the inner member) between an open position and a covered position. In the open position, the cavity is accessible. In the covered position the cavity is covered or closed off by the outer shell. In the covered position the outer shell may restrict air flow to the cavity to facilitate extinguishing the heat source.

When a heating element is included, the heating element may be exposed when the outer shell is in the covered position (covering the cavity or cavities) and may be referred to as an igniting position. In the closed position both the cavities or cavities and the heating element are enclosed by the outer shell. In the closed position the outer shell may be coextensive or substantially coextensive with the inner member. In the closed position, both the cavities or cavities and the heating element are not accessible.

The outer shell may define any elongated shape. The outer shell may define an elongated shape that conforms to the inner member elongated shape. The outer shell may define an elongated circular shape or an elongated non-round shape. The outer shell may define an elongated obround shape. The outer shell may define an elongated polygonal shape.

Exemplary polygonal shapes include trigonal shape, octagonal shape, rhomboidal shape, trapezoidal shape, and the like, in cross-section. Preferably the outer shell defines an elongated obround shape. The outer shell defines an inner shell surface that may conform to the inner member outer surface The outer shell may have a length (along the longitudinal axis) of less than about 120 mm, or less than about 100 mm or less than about 80 mm. The outer shell may have a length in a range from about 40 mm to about 120 mm, or from about 50 mm to about 100 mm, or from about 50 mm to about 80 mm, or from about 50 mm to about 70 mm. The outer shell is coextensive with the inner member. The outer shell and inner member may have the same or a substantially similar length.

The outer shell may have an outer perimeter or circumference sized to be grasped in a single hand of a user. The outer shell may have an outer perimeter or circumference of less than about 100 mm or less than about 90 mm. The outer shell may have an outer perimeter or circumference in a range from about 50 mm to about 100 mm or from about 50 mm to about 80 mm.

The outer shell may be defined by a heat conducting material. The outer shell may be defined by a heat insulating material. The outer shell may include a metallic outer surface and a heat insulating inner surface. Preferably the outer shell includes a heat insulating material or surface adjacent to the cavity or cavities in the covered or closed position. The heat insulating material may define at least a portion of the inner shell surface adjacent to the cavity or cavities in the covered or closed position. The heat insulating material may include a ceramic, an aerogel, or a polymer.

The portable extinguisher may be formed of a heat insulating material to retain the heat or a heat sink or heat conducting material to dissipate the heat throughout the portable extinguisher. Preferably, the outer surface of the portable extinguisher maintains a temperature of less than about 50 degrees Celsius, or less than about 40 degrees Celsius, or less than about 35 degrees Celsius, or less than about 30 degrees Celsius when extinguishing the solid heat source of the aerosol generating article received within the cavity and in the covered position.

The outer shell may include a guide element or slot. The guide element or slot may extend through the outer shell and extend along and parallel with the longitudinal axis of the inner member. The guide element or slot may extend at least 50% of the length of the outer shell, or from about 75% to about 99% of the length of the outer shell, or from about 80% to about 95% of the length of the outer shell.

The outer shell may include may be configured to break off the combusting solid heat source from the aerosol generating article. The outer shell may have a blunt outer edge that may shear off the combusting solid heat source by moving the outer shell into the covered position once the combusting solid heat source is received in the cavity. The blunt outer edge may facilitate separation of the solid heat source from the aerosol generating article. The outer shell may have a rounded or curved outer edge that may shear off the combusting solid heat source by moving the outer shell into the covered position once the combusting solid heat source is received in the cavity.

The outer shell may be configured to cut off the combusting solid heat source from the aerosol generating article. The outer shell may include a sharp edge or cutting element along the outer edge that may cut off the combusting solid heat source by moving the outer shell into the covered position once the combusting solid heat source is received in the cavity. The cutting element or sharp edge may facilitate separation of the solid heat source from the aerosol generating article. The cutting element may be a thin cutting edge, for example. The cutting element may be fixed to the outer shell and extend parallel with the longitudinal axis of the inner member.

The inner member may include a driving member fixed to the inner member. The driving element may protrude away from the inner member and be fixed along the length of the inner member. The driving member may be located away from the centroid of the inner member to provide an indication of orientation of the extinguisher. The driving member may extend through the outer shell. The driving member may extend through the guide element or slot of the outer shell.

The driving member may allow a consumer or user to actuate the inner member relative to the outer shell. The user may actuate the driving member with a single finger or thumb, for example, while holding the outer shell in the same hand. Actuating or moving the driving member in a first direction (relative to the outer shell) moves the inner member first portion to the open position to expose the cavity or cavities. Reversing the movement of the driving member (along a second direction opposing the first direction) moves the inner member first portion to the covered or closed position to cover the cavity or cavities with the outer shell. Actuating or moving the driving member further in the second direction moves the inner member second portion to an igniting position and exposing the heating element. Moving the driving member along the guide element moves the inner element from an igniting position (exposing the heating element with a covered cavity or cavities) to a covered position (where both the heating element and cavity or cavities are covered) and further movement of the driving member along the guide element move the inner element to the open position (exposing the cavity or cavities and the heating element is covered).

In the open position (exposing only the cavity or cavities) the first portion is exposed or extended away from the outer shell. About 30% to 60% of the inner member may be exposed in the open position. About 20 mm to about 35 mm of the inner member may be exposed in the open position.

In the igniting position (exposing only the heating element) the second portion is exposed or extended away from the outer shell. About 20% to 40% of the inner member may be exposed in the open position. About 10 mm to about 25 mm of the inner member may be exposed in the igniting position.

In the covered position (where the outer shell covers the cavities or cavities and optionally also the heating element) the inner member longitudinal length is at least about 90%, or at least about 95%, or at least about 99% covered by the outer shell. Preferably the outer shell is substantially coextensive (the same length) with the inner member.

The portable extinguisher may be operated by exposing the cavity or cavities and then inserting a combusting heat source of an aerosol generating article into the cavity. Once the solid heat source is received within the cavity the user may then cut, break, or snap off the solid heat source (as described above) and maintain the severed heat source within the cavity.

A kit may include the portable extinguisher described herein and one or more aerosol generating articles having a solid heat source. Preferably the kit includes two or more aerosol generating articles or five or more aerosol generating articles. The portable extinguisher may be utilized to extinguish a plurality of the aerosol generating articles in series or at the same time.

A typical aerosol generating article has a diameter in a range from about 6 mm to about 9 mm or from about 7 mm to about 8 mm. A typical aerosol generating article has a length in a range from about 60 mm to about 100 mm, or from about 70 mm to about 85 mm, or about 80 mm.

The solid heat source may have a diameter substantially equal to the diameter of the aerosol generating article. The solid heat source may have a diameter in a range from about 6 mm to about 9 mm or from about 7 mm to about 8 mm. The solid heat source may have a length in a range from about 6 mm to about 11 mm or from about 7 mm to about 9 mm. The solid heat source may define a monolithic element. Following combustion, the solid heat source has a substantially similar or the same physical dimensions as the non-combusted solid heat source.

The aerosol generating article includes a housing extending from a proximal end to a distal end. The housing defines an outer surface of the aerosol generating article. A solid heat source defines the distal end. The mouthpiece defines the proximal end. An aerosol generating substrate is disposed within the housing and between the proximal and distal end. A heat conducting element may transfer heat generated by the solid heat source to air flowing into the aerosol generating substrate and the aerosol generating substrate itself. The heated air and aerosol generating substrate generates an aerosol containing nicotine that passes through the mouthpiece to the user.

Preferably the solid heat source is a 'blind' heat source where in use combustion gas does not contact the aerosol-forming substrate or combine with the inhalation air. Preferably, the solid heat source is a carbonaceous heat source. As used herein, the term 'carbonaceous' is used to describe a combustible heat source comprising carbon. Preferably, carbonaceous heat sources for use in nicotine consumable articles according to the invention have a carbon content of at least about 35 percent, more preferably of at least about 40 percent, most preferably of at least about 45 percent by dry weight of the combustible heat source. The solid heat sources may be combustible carbon-based heat sources. As used herein, the term 'carbon-based heat source' is used to describe a heat source comprised primarily of carbon, such as carbon powder, for example. The solid heat source may be a carbonaceous heat source comprising carbon powder and at least one ignition aid, as described in WO2012/164077.

Exemplary solid heat sources may be formed from a mixture of: carbon powder; modified cellulose, such as, for example, carboxymethyl cellulose; flour such as, for example, wheat flour; and sugar such as, for example, white crystalline sugar derived from beet. Further exemplary solid heat sources may be formed from a mixture of carbon powder, modified cellulose, such as, for example, carboxymethyl cellulose; and optionally bentonite.

Advantageously, carbonaceous solid heat sources for use with the extinguisher described herein may have an apparent density of between about 0.6 g/cm$^3$ and about 1 g/cm$^3$. The solid heat source may have a mass of between about 1 gram and about 10 grams. The carbonaceous heat source is not formed from loose tobacco or tobacco material of a smoking article.

The aerosol-forming substrate comprises at least one aerosol-former and a material capable of releasing volatile compounds in response to heating. The aerosol-forming substrate may comprise other additives and ingredients including, but not limited to, humectants, flavourants, binders and mixtures thereof. Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the aerosol generating article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in aerosol generating articles herein are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenized plant-based material. For example, the aerosol-forming substrate may comprise one or more materials derived from plants including, but not limited to: tobacco; tea, for example green tea; peppermint; laurel; eucalyptus; basil; sage; verbena; and tarragon. Preferably, the material capable of emitting volatile compounds in response to heating is a charge of tobacco-based material, most preferably a charge of homogenized tobacco-based material.

Preferably, the aerosol-forming substrate has a mass of between about 1 gram and about 5 grams, more preferably of between about 1.5 grams and about 3 grams.

The aerosol generating articles that may be utilized with the extinguisher may comprise one or more air inlets around the periphery of the aerosol-forming substrate compartment. In such embodiments, in use, cool air is drawn into the aerosol-forming substrate through the air inlets. The air drawn into the aerosol-forming substrate through the air inlets passes downstream through the aerosol-forming substrate and exits the nicotine consumable articles through an aerosol outlet. In smoking devices, the aerosol continues through a mouthpiece to the consumer.

The aerosol generating articles that may be utilized with the extinguisher may comprise a heat-conducting element around and in direct contact with both at least the heat source and the aerosol-forming substrate. The heat-conducting element provides a thermal link between the heat source and the aerosol-forming substrate and advantageously helps to facilitate adequate heat transfer from the heat source to the aerosol-forming substrate to provide an acceptable aerosol. Preferably the heat-conducting element forms at least a portion of the housing of the aerosol generating article. Suitable heat-conducting elements for use herein include, but are not limited to: metal or metal foil such as, for example, aluminum foil, steel, iron foil and copper foil; and metal alloy foil.

All scientific and technical terms used herein have meanings commonly used in the art unless otherwise specified. The definitions provided herein are to facilitate understanding of certain terms used frequently herein.

The terms "upstream" and "downstream" refer to relative positions of elements of the aerosol generating article described in relation to the direction of inhalation air flow as it is drawn through the body of the aerosol generating article from a distal portion to the mouthpiece portion.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments form the scope of the disclosure, including the claims.

The schematic drawings are not necessarily to scale and are presented for purposes of illustration and not limitation. The drawings depict one or more aspects described in this disclosure. However, it will be understood that other aspects not depicted in the drawing fall within the scope and spirit of this disclosure.

Figure 1:
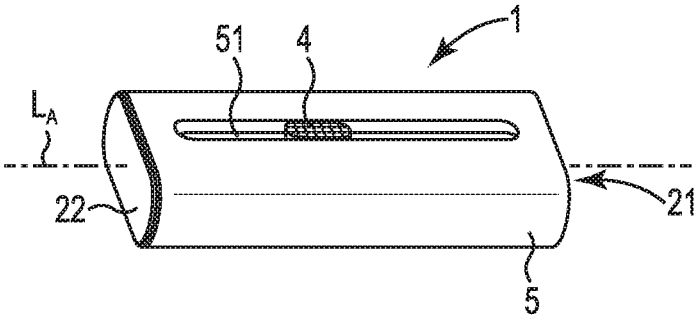
FIG. 1 is a perspective view of an illustrative portable extinguisher 1 in the covered and closed position.
Figure 2:
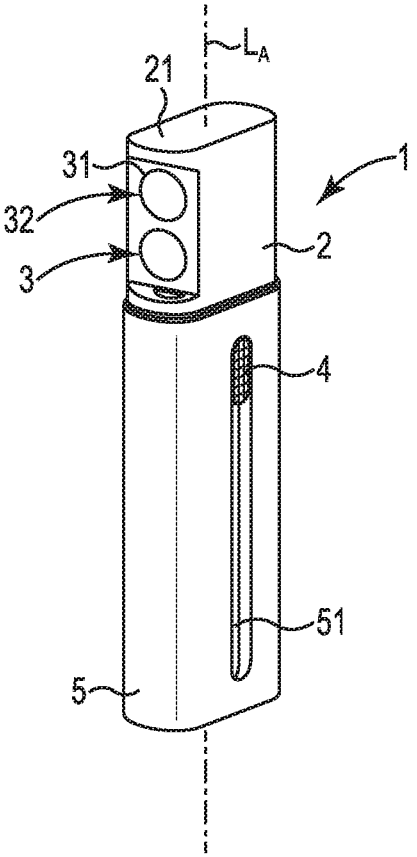
FIG. 2 is a perspective view of the illustrative portable extinguisher 1 in the open position.

The portable extinguisher 1 includes an inner element 2 extending between a first portion 21 and an opposing second portion 22 and having a longitudinal axis $L_A$. The first portion 21 includes a cavity 3 sized to receive a solid heat source 102 of an aerosol generating article 100 (see FIG. 5). An outer shell 5 completely surrounds at least a portion of the inner element 2. The outer shell 5 is slidable along the longitudinal axis $L_A$ of the inner element 2 between an open position (see FIG. 2) and a covered or closed position (see FIG. 1). The cavity 3 is accessible in the open position and surrounded by the outer shell 5 in the covered position.

The portable extinguisher 1 may include a driving member 4 fixed to the inner element 2 and is movable along a guide element 51 of the outer shell 5 to move the inner element 2 between the open position and a covered position. The cavity 3 may be configured to separate the combusting heat source 102 from the expended aerosol generating article 100. The inner element 2 may include two or more cavities 3, 32. The cavity 3 or outer shell 5 may be insulated to contain or dissipate the heat remaining in the received solid heat source 102 contained within the cavity and outer shell 5.

Figure 3:
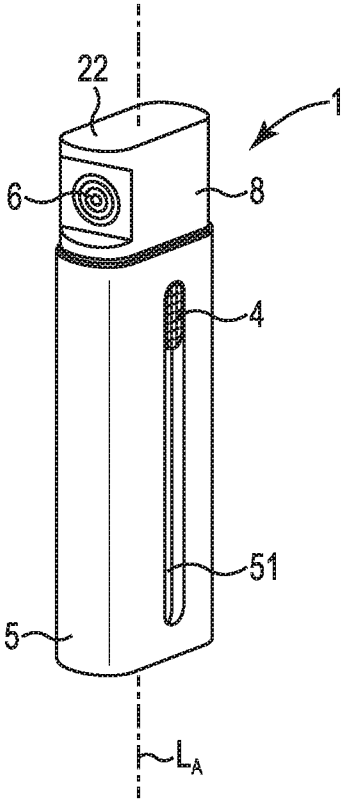
FIG. 3 is a perspective view of an illustrative portable extinguisher 1 in the igniting position.
Figure 4:
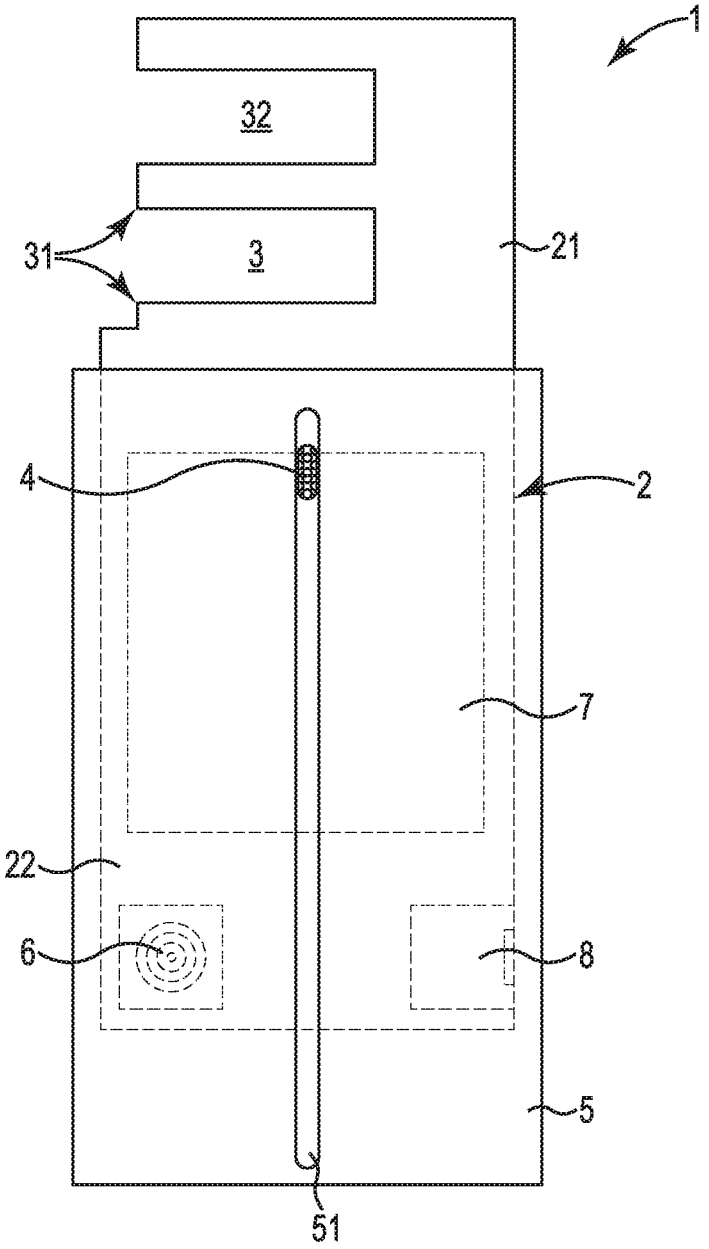
FIG. 4 is a schematic diagram of an illustrative portable extinguisher 1 in the open position.

The portable extinguisher 1 may include a heating element 6 on the second portion 22 of the inner element 2. The outer shell 5 may be configured to be co-extensive with the inner element 2 in the closed position (see FIG. 1). The outer shell 5 may be slidable along the longitudinal axis $L_A$ of the inner element 2 to expose the heating element 6 in an igniting position (see FIG. 3). The consumer may activate the heating element 6 to ignite a solid heat source 102 of an aerosol generating article 100. A battery or rechargeable power supply 7 may be contained within the inner element 2 and electrically coupled to the heating element 6. A USB element or micro-USB device may be electrically coupled to the battery or rechargeable power supply 7 to recharge the battery or power supply 7. Alternatively, the heating element 6 is a flame lighter.

In use, a consumer may insert the solid heat source 102 end of a consumed aerosol generating article 100 into the cavity 3 and separate the solid heat source 102 that is contained or received within the cavity 3 from the aerosol generating article 100. In certain embodiments, the cavity 3 may have a sharp edge or cutting element 31 to facilitate the detachment or separation of the solid heat source 102 that is contained or received within the cavity 3 from the aerosol generating article 100. Once the combustible heat source 102 has been separated from the aerosol generating article 100 and retained within the cavity 3, the outer shell 5 may slide over the cavity 3 to cover the open end of the cavity 3. The contained combusting heat source 102 may then be extinguished within the cavity 3. Once extinguished and cooled, the extinguished solid heat source may then be discarded.

Figure 5:
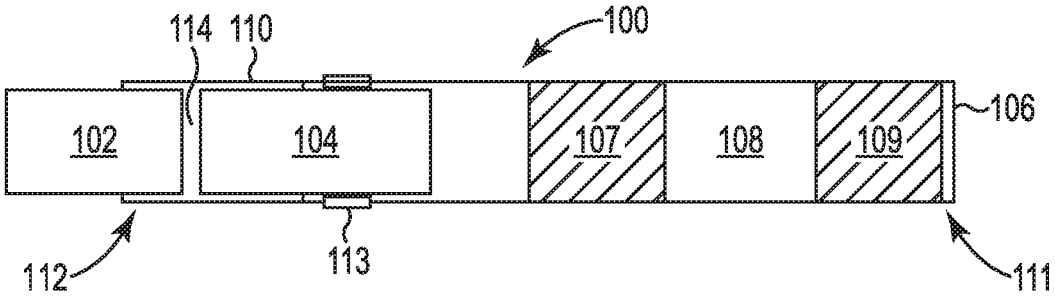
FIG. 5 is a schematic diagram of an illustrative aerosol generating article 100.

Referring now to FIG. 5, an aerosol generating article 100 includes a housing 110 extending between a proximal end 111 and a distal end 112. The aerosol generating article 100 includes a solid heat source 102 positioned at the distal end 112 of the aerosol generating article 100, an aerosol-forming substrate 104 downstream of the solid heat source 102 and a mouthpiece 106 downstream of the aerosol-forming substrate 104 and positioned at the proximal end 111 of the aerosol generating article 100.

The aerosol generating article 100 may comprises an aerosol-cooling element 107, an elongate expansion chamber or transfer element 108, in sequential, abutting coaxial alignment, between the aerosol-forming substrate 104 and the mouthpiece 106. The aerosol generating article 100 may not include all of these elements or may include additional elements. The housing 110 may be overwrapped in an outer wrapper of cigarette paper. The solid heat source 102 may be cylindrical. During consumption, only the solid heat source 102, of the aerosol generating article 100, combusts. Thus, the housing 110 and aerosol-forming substrate 104 may not combust during consumption of the aerosol generating article 100.

The aerosol-generating substrate 104 may be located immediately downstream of the solid heat source 102 and comprise a cylindrical plug of homogenized tobacco material comprising, for example, glycerine as aerosol former and circumscribed by filter plug wrap. A heat-conducting element 114, consisting of a tube of aluminum foil for example, surrounds and is in contact with a rear portion of the solid heat source 102 and an abutting front portion of the aerosol-generating substrate 104. The elongate expansion chamber 108 may be located downstream of the aerosol-generating substrate 104 and comprises a cylindrical open-ended tube of cardboard. The mouthpiece 106 is located downstream of the expansion chamber 108 and comprises a cylindrical plug of cellulose acetate tow 109 circumscribed by filter plug wrap.

In use, the user ignites the solid heat source which heats the aerosol-forming substrate to produce an aerosol. When the user inhales on the mouthpiece 106, air is drawn through the aerosol-forming substrate 104 through air inlet holes 113 in the housing 110 and adjacent to the aerosol-forming substrate 104, through the expansion chamber 108, through the mouthpiece 106 and into the consumer's mouth. The solid heat source 102 may remain hot for several minutes following consumption of the aerosol-generating substrate 104. The still hot solid heat source 102 may be inserted into the portable extinguisher 1 and separated off into the cavity 3 to extinguish and cool the combusting solid heat source 102.

The specific embodiments described above are intended to illustrate the invention. However, other embodiments may be made without departing from the spirit and scope of the invention as defined in the claims, and it is to be understood that the specific embodiments described above are not intended to be limiting.

The invention claimed is:

1. A portable extinguisher for extinguishing a solid heat source of an aerosol generating article, the extinguisher comprising:

an inner element extending between a first portion and an opposing second portion and having a longitudinal axis, the first portion comprising a cavity sized to receive a solid heat source of an aerosol generating article, the cavity defining a cylinder and extending from a closed to an open end, the cylinder having a solid wall; and an outer shell completely surrounding at least a portion of the inner element, the outer shell being slidable along the longitudinal axis of the inner element between an open position and a covered position, the cavity being accessible in the open position and surrounded by the outer shell in the covered position, wherein the outer shell completely surrounds the at least a portion of the inner element in the open position and the covered position, the inner element comprises a driving member that is movable along a guide element of the outer shell.

2. The extinguisher according to claim 1, wherein the driving member extends through the outer shell.

3. The extinguisher according to claim 1, wherein the guide element is parallel to the longitudinal axis of the inner element.

4. The extinguisher according to claim 1, wherein the cavity has a length extending along a direction orthogonal to the inner element longitudinal axis.

5. The extinguisher according to claim 1, wherein the cavity comprises a cutting element fixed to the open end of the cavity.

6. The extinguisher according to claim 1, wherein the first portion comprises two or more cavities, where each cavity is sized to receive a solid heat source of an aerosol generating article.

7. The extinguisher according to claim 1, wherein the outer shell comprises a heat insulating material adjacent to the cavity in the covered position.

8. The extinguisher according to claim 1, wherein the outer shell defines an elongated obround shape.

9. The extinguisher according to claim 1, wherein the first portion comprises a heat sink in thermal contact with the cavity.

10. The extinguisher according to claim 1, wherein the inner element comprises a phase change material in thermal connection with the cavity.

11. The extinguisher according to claim 1, wherein air flow is restricted to the cavity in the covered position.

12. The extinguisher according to claim 1, wherein the second portion comprises a heating element.

13. The extinguisher according to claim 1, wherein the second portion comprises a battery that may be electrically connected to a USB element.

14. The extinguisher according to claim 1, wherein the outer shell is coextensive with the inner element in the covered position.

15. A portable extinguisher for extinguishing a solid heat source of an aerosol generating article, the extinguisher comprising:

an inner element extending between a first portion and an opposing second portion and having a longitudinal axis, the first portion comprising a cavity sized to receive a solid heat source of an aerosol generating article; and an outer shell completely surrounding at least a portion of the inner element, the outer shell being slidable along the longitudinal axis of the inner element between an open position and a covered position, the cavity being accessible in the open position and surrounded by the outer shell in the covered position, wherein the outer shell completely surrounds the at least a portion of the inner element in the open position and the covered position, the inner element comprises a driving member that is movable along a guide element of the outer shell wherein the cavity comprises a cutting element fixed to an open end of the cavity.

16. The extinguisher according to claim 15, wherein the first portion comprises two or more cavities, where each cavity is sized to receive a solid heat source of an aerosol generating article.

17. The extinguisher according to claim 15, wherein the first portion comprises a heat sink in thermal contact with the cavity.

18. The extinguisher according to claim 15, wherein the second portion comprises a heating element.

19. The extinguisher according to claim 15, wherein the outer shell comprises a heat insulating material adjacent to the cavity in the covered position.

20. The extinguisher according to claim 15, wherein the second portion comprises a battery.

* * * * *